US009618869B2

(12) United States Patent
Lee et al.

(10) Patent No.: US 9,618,869 B2
(45) Date of Patent: Apr. 11, 2017

(54) PRINTING USING A METAL-SURFACE CHARGING ELEMENT

(75) Inventors: Michael H Lee, San Jose, CA (US); Omer Gila, Cupertino, CA (US); Seongsik Chang, Santa Clara, CA (US); Paul F Matheson, San Bruno, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 88 days.

(21) Appl. No.: 14/379,310

(22) PCT Filed: Apr. 30, 2012

(86) PCT No.: PCT/US2012/035840

§ 371 (c)(1),
(2), (4) Date: Aug. 18, 2014

(87) PCT Pub. No.: WO2013/165362

PCT Pub. Date: Nov. 7, 2013

(65) Prior Publication Data

US 2015/0037070 A1 Feb. 5, 2015

(51) Int. Cl.
*G03G 15/02* (2006.01)

(52) U.S. Cl.
CPC ..... *G03G 15/0216* (2013.01); *G03G 15/0233* (2013.01)

(58) Field of Classification Search
CPC ..... G03G 15/0233
USPC ..... 399/176
See application file for complete search history.

(56) References Cited

U.S. PATENT DOCUMENTS 5,258,811 A * 11/1993 Miyake ..... G03G 15/0896 399/167
5,305,177 A 4/1994 Aoki
5,464,721 A 11/1995 Yagi
5,581,331 A * 12/1996 Teshigawara ..... G03G 15/0105 399/171
5,678,129 A * 10/1997 Yasuda ..... G03G 15/0266 219/497
5,742,880 A 4/1998 Takenaka
(Continued)

FOREIGN PATENT DOCUMENTS

CN 1165983 A 11/1997
CN 200950209 9/2007
(Continued)

OTHER PUBLICATIONS

D'Antonio, Characteristics of In-air Thermoplastic Recording, Applied Optics, vol. 8, Issue S1, 1969, pp. 142-148, abstract only.
(Continued)

*Primary Examiner* — David Gray
*Assistant Examiner* — Tyler Hardman
(74) *Attorney, Agent, or Firm* — HP Inc. Patent Department

(57) ABSTRACT

Techniques related to printing using a metal-surface charging element. A printing system includes a metal-surface charging element and a power supply. The charging element is disposed to deposit electric charge on an imaging surface. The power supply may provide electric power with an alternating current (AC) component and a direct current (DC) component to the charging element.

16 Claims, 9 Drawing Sheets

(56) References Cited

U.S. PATENT DOCUMENTS

| | | | | |
|---|---|---|---|---|
| 5,778,775 | A | 7/1998 | Schafer | |
| 6,070,033 | A | 5/2000 | Hiraoka et al. | |
| 6,359,638 | B1 | 3/2002 | Saeki | |
| 7,050,742 | B2 | 5/2006 | Gila et al. | |
| 7,395,011 | B2 | 7/2008 | Tanaka | |
| 7,583,914 | B2 | 9/2009 | Hatakeyama et al. | |
| 7,756,430 | B1 | 7/2010 | Chang | |
| 8,105,672 | B2 | 1/2012 | Nakamura et al. | |
| 2002/0051654 | A1 | 5/2002 | Nimi et al. | |
| 2004/0213600 | A1 | 10/2004 | Watanabe | |
| 2007/0127950 | A1 | 6/2007 | Gila | |
| 2008/0085131 | A1* | 4/2008 | Kitazawa | G03G 15/0266 399/48 |
| 2008/0267646 | A1* | 10/2008 | Oron | G03G 15/5037 399/48 |
| 2010/0080631 | A1 | 4/2010 | Ogiyama et al. | |
| 2010/0183334 | A1 | 7/2010 | Fukunaga et al. | |
| 2011/0129258 | A1 | 6/2011 | Shin et al. | |
| 2011/0262183 | A1* | 10/2011 | Seto | G03G 21/1821 399/117 |
| 2012/0033984 | A1 | 2/2012 | Ikeda | |

FOREIGN PATENT DOCUMENTS

| | | | |
|---|---|---|---|
| EP | 1209542 | | 5/2002 |
| EP | 1542087 | A2 | 6/2005 |
| EP | 1841301 | | 10/2007 |
| GB | 2282672 | A | 4/1995 |
| JP | 9054479 | | 2/1997 |
| JP | 2000029320 | | 1/2000 |
| JP | 3033028 | | 4/2000 |
| JP | 2007187814 | | 7/2007 |
| JP | 2010107796 | | 5/2010 |
| WO | WO-2007064975 | A1 | 6/2007 |
| WO | WO-2012105987 | | 8/2012 |

OTHER PUBLICATIONS

Fridman et al., Non-thermal atmospheric pressure discharges, Institute of Physics Publication, 2005, pp. R1-R24.

Kadonaga et al., A Study of Non-Uniform charging by Charging Roller with DC Voltage, Journal of Imaging Science and Technology, vol. 43, No. 3, May/Jun. 1999, 6 pp.

Kogelschatz, Filamentary and Diffuse Barrier Discharges, accessed at http://etds.lib.ncku.edu.tw, printed from website Oct. 2012.

* cited by examiner

PRINTING USING A METAL-SURFACE CHARGING ELEMENT

BACKGROUND

High-speed digital printing systems, of which an example is the Indigo printing system by Hewlett-Packard Company, have progressed to the point that the output is virtually indistinguishable from the high-quality printing that formerly was associated only with offset lithography. This new digital printing technology uses inks that can be attracted or repelled by a static electric charge. A uniform charge is deposited on an imaging surface by a voltage differential between the electrical ground beneath the imaging surface and a charging element, such as a charge roller. The charge roller comprises a metal shaft coated with an electrically-resistive composition such as polyurethane rubber with additional conductive agents. This rubber coating assures uniform charge distribution on the imaging surface. Then a pattern is formed in the charge on the imaging surface by a scanning laser. Inks of various colors are applied to the imaging surface according to the charge pattern. These patterns of ink are then transferred onto paper. The ink is specially formulated so as not to mask the underlying surface roughness or glossiness of the paper.

BRIEF DESCRIPTION OF THE DRAWINGS

The figures are not drawn to scale. They illustrate the disclosure by examples.

DETAILED DESCRIPTION

Figure 1:
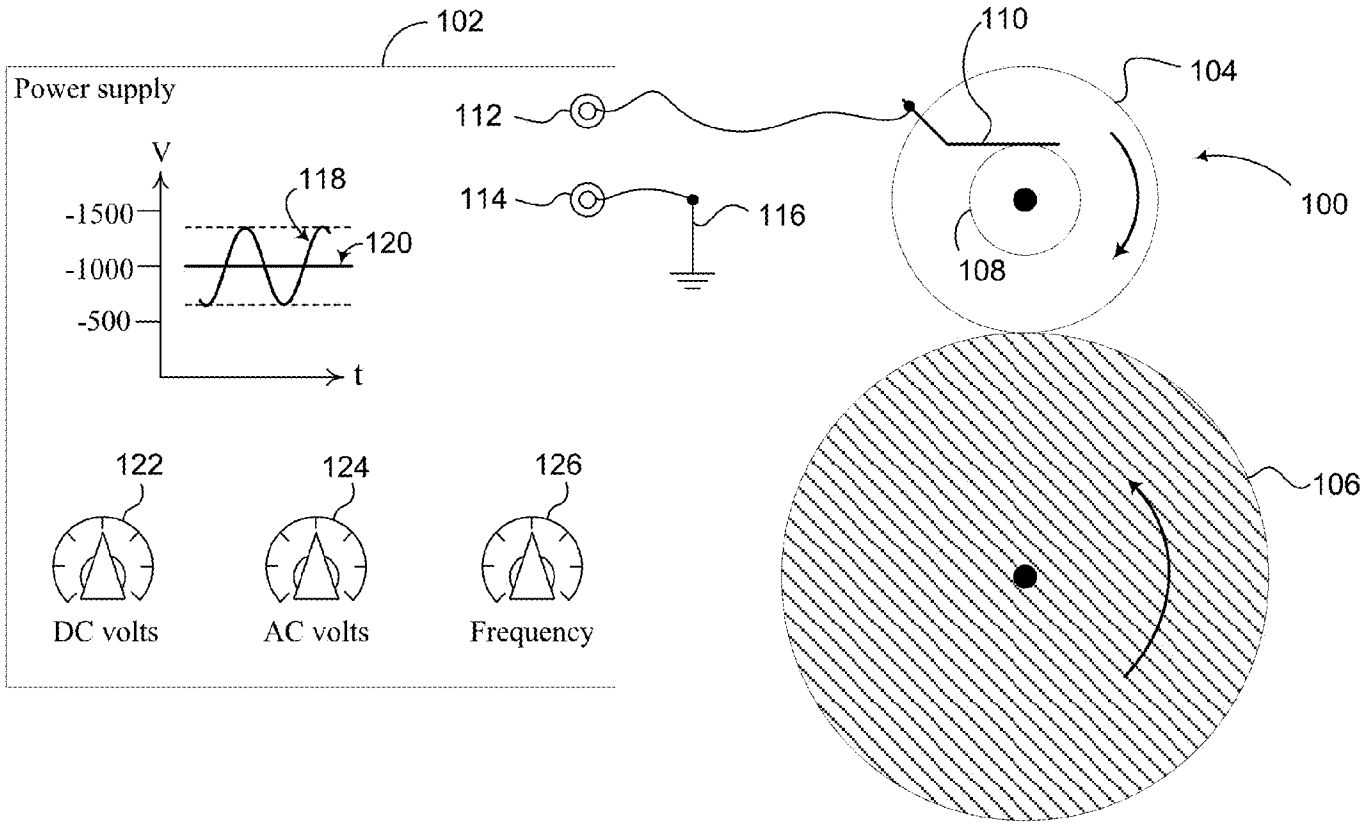
FIG. 1 is a partial schematic of an example of a printing system having a metal-surface charging element and a power supply to provide electric power with AC and DC components.

Illustrative examples and details are used in the drawings and in this description, but other configurations may exist and may suggest themselves. Parameters such as voltages, temperatures, dimensions, and component values depend on the exact printing system implementation and are approximate for some typical Indigo printing systems. Terms of orientation such as up, down, top, and bottom are used only for convenience to indicate spatial relationships of components with respect to each other, and except as otherwise indicated, orientation with respect to external axes is not critical. "Ground" refers to a common return, not necessarily to any earth ground. For clarity, some known methods and structures have not been described in detail. Methods defined by the claims may comprise steps in addition to those listed, and except as indicated in the claims themselves the steps may be performed in another order than that given. Accordingly, the only limitations are imposed by the claims, not by the drawings or this description.

Charging elements used in high-speed digital printing systems have a finite lifetime because their rubber coatings deteriorate with use. Although this lifetime may be measured in hundreds of thousands of printed sheets of paper, these presses have such high throughput that the charging elements may need to be replaced as often as every several days. The frequent replacements of charging elements can add to the total cost of operating the printing system. There is a need for a way to reduce or eliminate the need for replacement of charging elements in high-speed digital printing without compromising print quality. This may be particularly advantageous with printers characterized by a high throughput and print quality, such as liquid electrophotographic printers, of which the Indigo printing system by Hewlett-Packard Company is an example. An electrophotographic printer encompasses a print system in which a discharge source (e.g., a laser beam scanner) scans a charged imaging surface (e.g., a photoconductor) to form an electrostatic latent image on the imaging surface; a liquid developer of a selected color is applied to the electrostatic latent image to develop the electrostatic latent image; and the developed image is printed on a print medium via a transfer unit (e.g., an intermediate transfer drum and an impression drum). At least some of the examples below are illustrated with respect to liquid electrophotographic printers. However, examples are not limited to liquid electrophotographic printers.

A partial schematic of a printing system having a metal-surface charging element is shown in FIG. 1. The system includes a charging element generally 100 and a power supply 102. The charging element 100 has an electrically-conducting metal surface 104 disposed to make rolling physical contact with, and to deposit electric charge on, an imaging surface 106. No compositions or other conductive agents attached to the charging element come between the charging element and the imaging surface. The benefit of using a metal-surface charging element is that it can last for the lifetime of the printing system with little or no degradation, or at least with lower degradation than a conventional charging element designed for being operated with a composition surface in charge-transferring relation with the imaging surface to deposit electric charge on the imaging surface. That is why the metal-surface charging element is sometimes referred to in this description as "permanent". However, the metal-surface charging element may be releasably mounted in the printing system to facilitate replacement if required. In some examples the charging element comprises a solid metal roller. In some other examples it comprises a metal roller with a hollow core as described in more detail presently.

The charging element 100 carries a slip contact 108 in electrical communication with a contact arm 110 that in turn is connected to a first power output terminal 112 of the power supply 102. A second power output terminal 114 is connected to ground 116 and thence to the imaging surface 106. In other examples, other connection techniques are instead used to couple electric power from the power supply to the charging element 100.

In some examples a printing system with a metal-surface charging element may include a power supply to provide the charging element with electric power that has both alternating current (AC) and direct current (DC) components. For example, in FIG. 1 the electric power provided by the power supply 102 includes an AC component 118 and a DC component 120. The magnitude of the DC component is determined by the desired imaging surface potential. In this example the DC component provides a bias of about −1,000 volts (that is, the charging element 100 is biased negatively with respect to the imaging surface). In some examples, the DC bias may be between about −900 and −1,050 volts; in other examples the DC bias may be between about −500 volts and −1,200 volts; and in still other examples the DC bias may be in a different voltage range. In some examples the DC bias is positive rather than negative with respect to ground. The choice of polarity and magnitude of the DC bias will depend on design and construction of the printer, including such factors as the size of the charging element, the size and composition of the imaging surface, the charging propensity of the marking ink, and the physical disposition of the various parts of the printer. The value of the DC bias in a given example also depends on the desired potential on the imaging surface, and in some examples this is generally related to the imaging-surface dielectric thickness and to the ink formulation.

In some examples the amplitude of the AC component is at least the Paschen air-discharge threshold potential. In this example of FIG. 1, the AC component has amplitude of about 700 volts peak-to-peak and a frequency of about 8 kHz. In other examples the AC component may have amplitude between about 600 and 800 volts and a frequency between about 5 and 10 kHz, and in still other examples the AC component may be between about 500 and 1,000 volts and between about 2 and 20 kHz. As with the DC bias, the amplitude and frequency of the AC component may be adjusted as needed for the various factors mentioned above, including among others the physical configuration of the charging element and of the imaging surface. The frequency should be high enough, in relation to the linear speed of the imaging surface, to avoid visible bands; in some examples a frequency of at least 4 kHz per meter/second of imaging surface speed gives good results.

The power supply 104 is provided with a DC voltage control 122, an AC voltage control 124, and an AC frequency control 126. These controls may be used to set the DC and AC components of the power output as desired.

Figure 2:
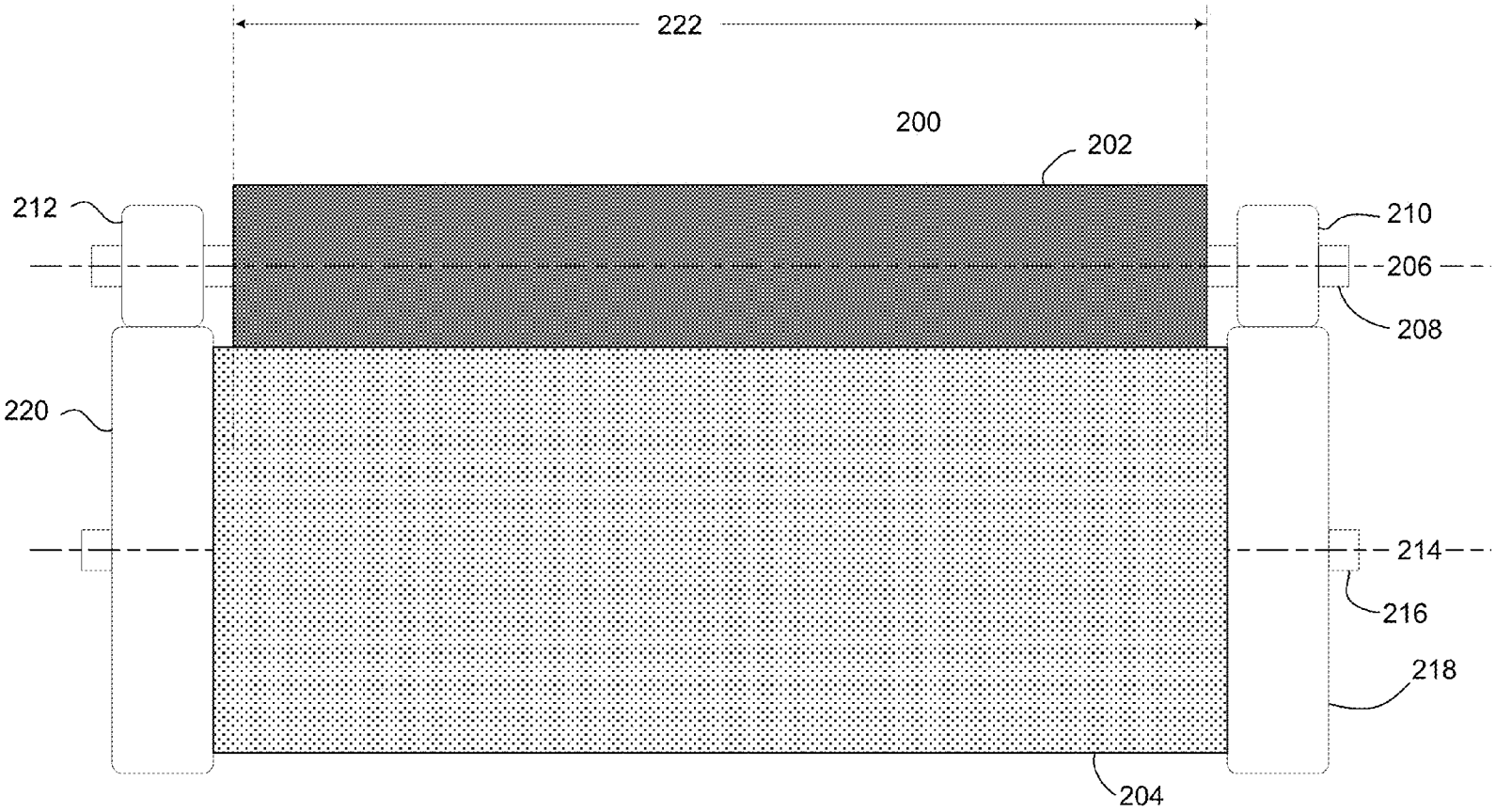
FIG. 2 is a side view of an example of a printing system having a metal charge roller in contact with an imaging surface.

FIG. 2 shows an example in which a metal-surface charging element generally 200 comprises a metal charge roller 202 rotationally coupled to an imaging surface 204. The roller 202 is in rolling physical contact with the imaging surface 204. The roller rotates about an axis 206 by means of a shaft 208 and is driven by the rotation of the imaging surface. A drive wheel 210 may be placed on one end of the shaft 208 and a drive wheel 212 may be placed on the other end of the shaft 208, for example in an Indigo implementation in which the imaging surface comprises a photoconductor in the form of a sheet. Such a photoconductor may have a recessed area formed by a seam where the photoconducting sheet overlaps. The imaging surface 204 rotates about an axis 214 by means of a shaft 216. Disks 218 and 220 are attached to opposing sides of the imaging surface. The drive wheel 210 touches the disk 218 only in the seam region where it prevents direct roller contact with the seam to avoid transferring debris accumulated in the seam onto the roller or the imaging surface. Similarly, the drive wheel 212 touches the disk 220 only in the seam region. Torque to rotate the imaging surface and the roller may be provided by a motor (not shown) that drives the shaft 216, for example through a drive gear (not shown) attached to the shaft 216. In this example the roller is slightly shorter than the imaging surface and defines an image area 222 on the imaging surface.

Figure 3:
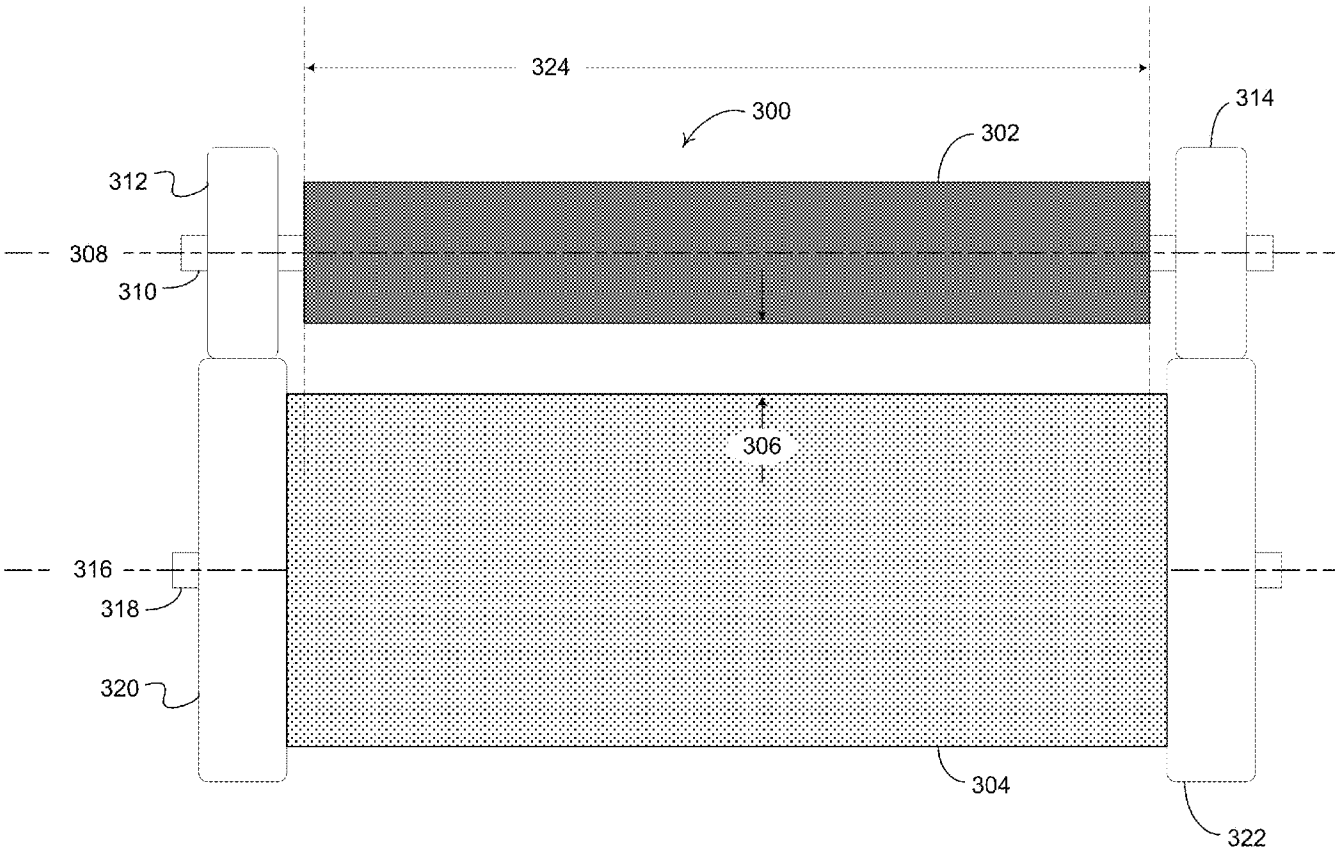
FIG. 3 is a side view of an example of a printing system having a metal charge roller spaced apart from an imaging surface by a gap.

FIG. 3 shows an example in which a metal-surface charging element generally 300 comprises a metal charge roller 302 rotationally coupled to an imaging surface 304. The roller 302 is separated from the imaging surface 304 by a gap 306. The roller rotates about an axis 308 by means of a shaft 310 and is driven by the rotation of the imaging surface 304 through coupling of intermediate surfaces as follows. A drive wheel 312 may be placed on one end of the shaft 310 and a drive wheel 314 may be placed on the other end of the shaft 310, for example in an Indigo implementation in which the imaging surface comprises a photoconductor in the form of a sheet. Such a photoconductor may have a recessed area formed by a seam where the photoconducting sheet overlaps. The imaging surface 304 rotates about an axis 316 by means of a shaft 318. Disks 320 and 322 are attached to opposing sides of the imaging surface. The drive wheel 312 touches the disk 320 and the drive wheel 314 touches the disk 322. Rotation of disks 320 and 322 causes drive wheels 312 and 314 and thereby roller 302 to turn. Torque to rotate the imaging surface and the roller may be provided by a motor (not shown) that drives the shaft 318, for example through a drive gear (not shown) attached to the shaft 318. In this example the charge roller 302 is slightly shorter than the imaging surface and defines an image area 324 on the imaging surface.

Figure 4:
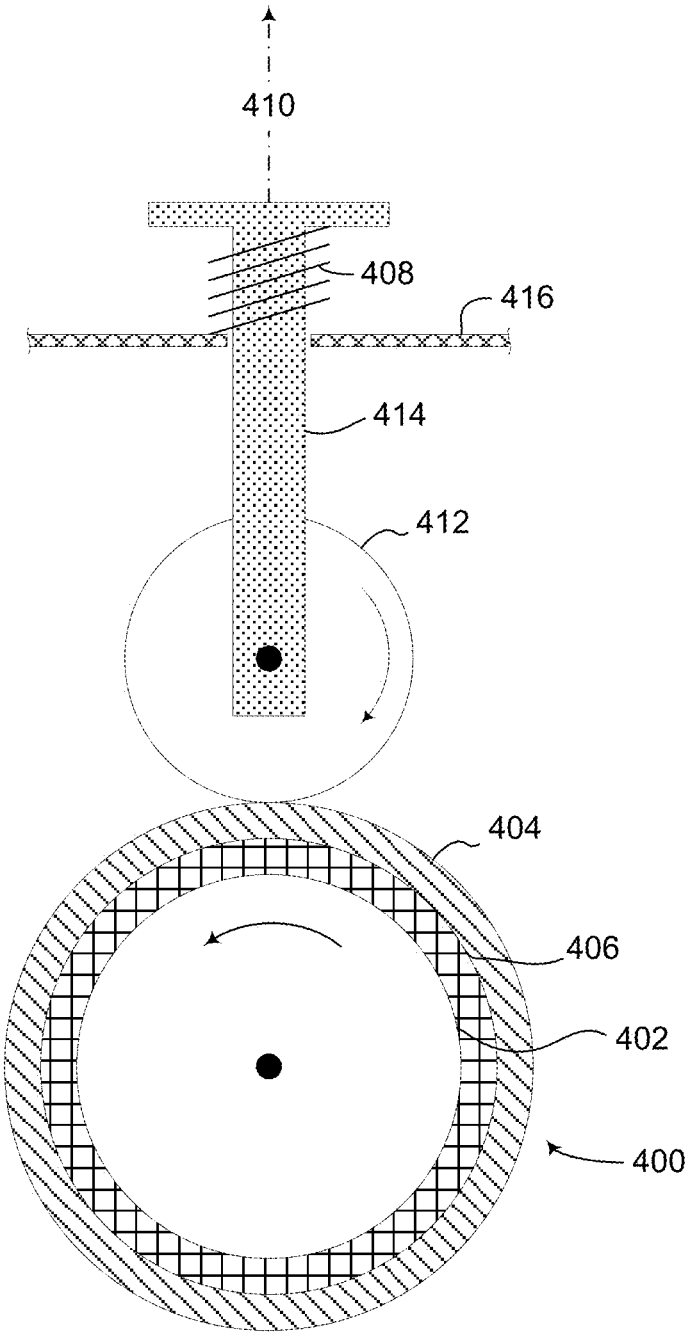
FIG. 4 is a schematic representation of an example of a printing system having a metal charge roller with a biasing spring.

As shown in FIG. 4, in some examples an imaging surface 400 comprises a drum 402 and a deformable photoconducting sheet 404 disposed over the drum. A fabric layer 406 may be disposed between the drum 402 and the sheet 404. In other examples the imaging surface comprises a dielectric drum with a surface such as glass or Mylar having a similar dielectric thickness (thickness/dielectric constant) to that of a typical organic photoconductor. Some such dielectric drums may be permanent in the sense that they last the life of the printer.

Also as shown in FIG. 4, some examples include a spring 408 to exert a force 410 between a metal-surface charging element 412 and the imaging surface 400. In this example the charging element is disposed above the imaging surface such that gravity urges the charging element into contact with the imaging surface. The gravitational force may be too great, especially for a charging element that comprises a solid metal roller, and may result in damage to the charge roller or the imaging surface. The force 410 exerted by the spring is generally opposite to the force of gravity on the charging element, reducing the net force with which the charging element is pressed against the imaging surface. The spring is compressed between a support arm 414 that carries the charging element and a fixed plate 416. In other examples the spring may be disposed to urge the charging element against the imaging surface.

Figure 5:
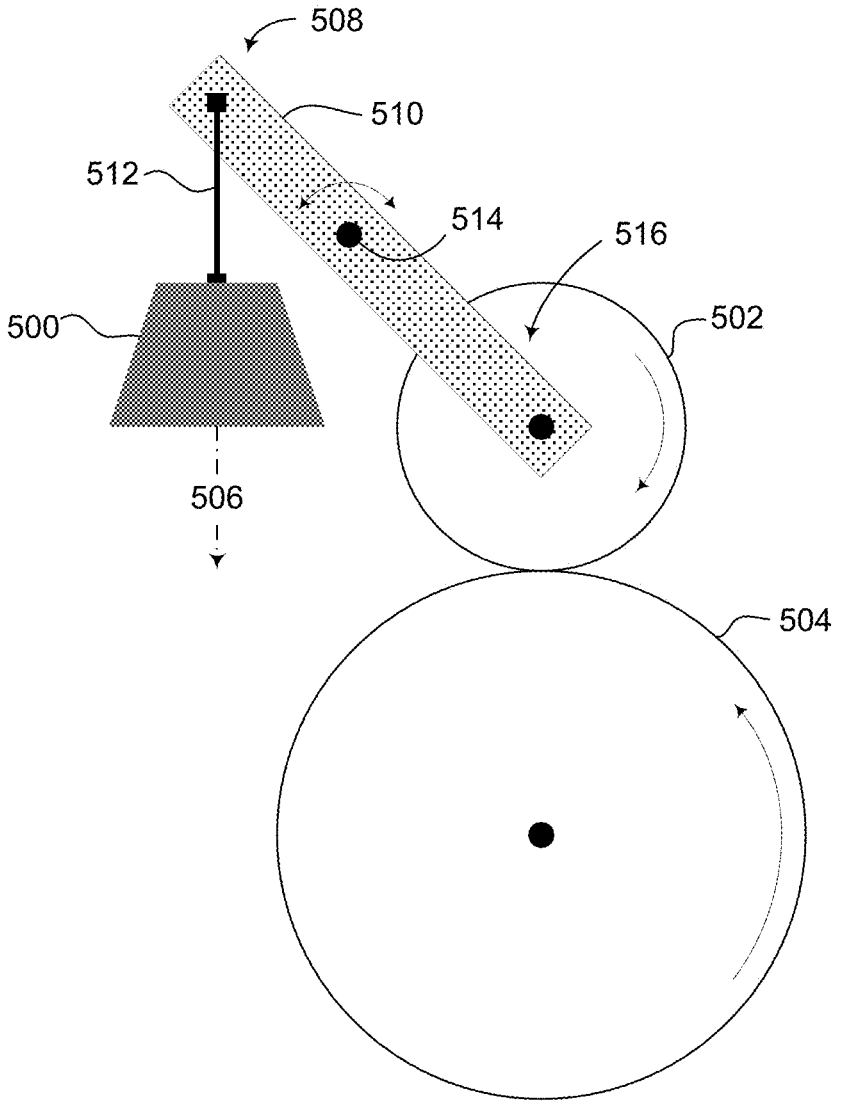
FIG. 5 is a schematic representation of an example of a printing system having a metal charge roller with a biasing weight.

Referring to FIG. 5, in some examples a weight 500 exerts a biasing force between a metal-surface charging element 502 and an imaging surface 504. In this example the weight, under the influence of gravity, exerts a downward force 506 on a first extremity 508 of a lever arm 510 through a connecting rod 512, urging the lever arm to pivot about its fulcrum 514 and exert an upward force on a second extremity 516 that carries the charging element 502. This reduces the gravitational force that urges the charging element 502 against the imaging surface 504. If more force rather than less is needed to urge the charging element 502 into contact with the imaging surface 504, the positions of the weight and the fulcrum along the lever arm 510 may be exchanged.

Figure 6:
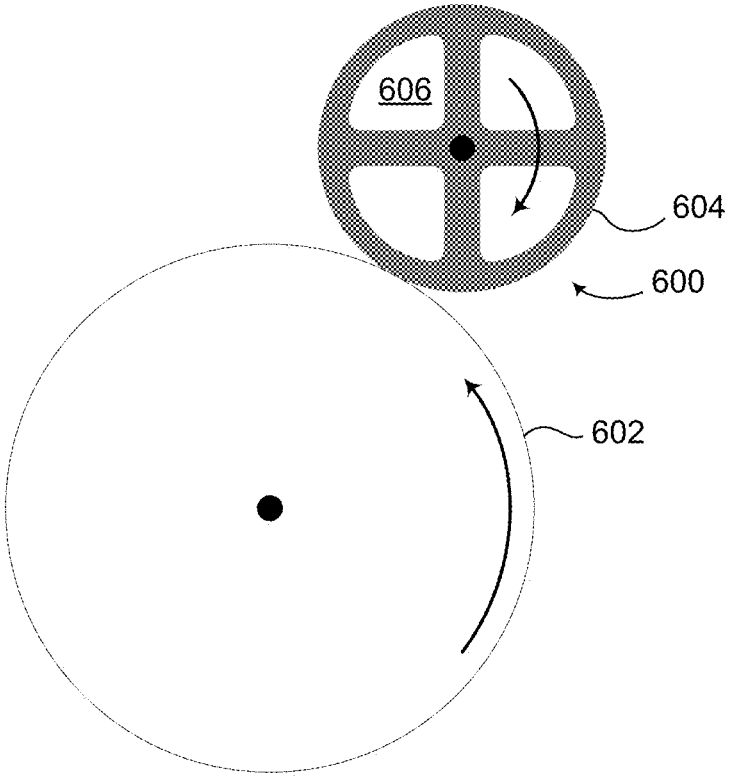
FIG. 6 is a schematic representation of an example of a printing system having a hollow metal charge roller.

In some of the above examples, the charging element comprises a solid metal roller with a metal surface. In another example, as shown in FIG. 6, a charging element 600 in contact with an imaging surface 602 comprises a hollow metal cylinder 604 enclosing air spaces such as an air space 606. Making the charging element hollow is another way to reduce the effect of gravity in urging the charging element against the imaging surface.

Figure 7:
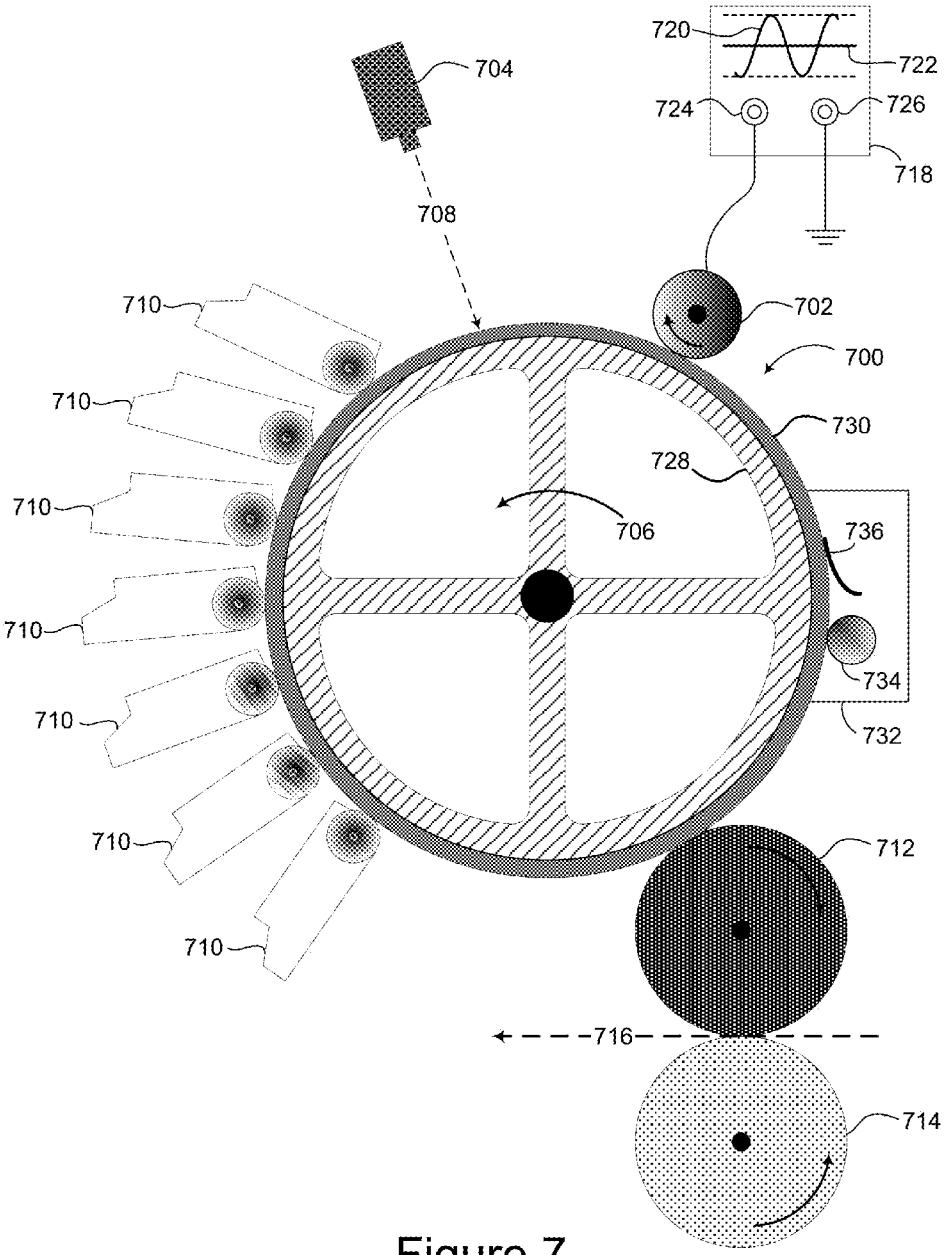
FIG. 7 is a schematic representation of an example of a printing system having a metal-surface charging element and a power supply to provide electric power with AC and DC components.

FIG. 7 gives an example of a printing system with a metal-surface charging element. The system is adapted for use with an imaging surface, in this example a photoconductor generally 700. A metal charge roller 702 is rotationally coupled to the photoconductor 700. The charge roller 702 is in charge-depositing relation with the photoconductor 700. In this example the charge roller 702 is in direct physical contact with the photoconductor 700; in other examples there may be a gap between them. A laser 704 is aimed at the photoconductor 700 and is rotationally downstream from (herein, "downstream from" means after or subsequent to) the metal charge roller 702 as indicated by an arrow 706 that shows the direction of rotation of the photoconductor. In other examples, the imaging surface may be responsive to some form of energy other than visible light and in such examples the laser is replaced with a suitable image-forming energy source. In operation, the laser 704 scans a light beam 708 across the photoconductor 700, forming a pattern in the charge that is deposited on the photoconductor by the charge roller 702. One or more ink developer rollers 710 are disposed in ink-dispensing relation with the photoconductor 700, downstream from the laser 704. In this example there are seven ink developer rollers for different color inks, but in other examples there may be more or less than seven. An intermediate transfer drum 712 is rotationally coupled to and in direct contact with the photoconductor 700, downstream from the ink developer rollers 710. An impression drum 714 is rotationally coupled to the intermediate transfer drum 712. A paper flow path 716 is defined between the impression drum 714 and the intermediate transfer drum 712. A power supply 718 provides electric power with an AC component 720 and a DC component 722. The power supply is connected to the charge roller 702 through a first terminal 724 in electrical communication with the charge roller and a second terminal 726 in electrical communication with ground.

The photoconductor may comprise a drum 728 and a photoconducting sheet 830 carried by the drum. As discussed previously, fabric or other material may be disposed between the drum and the photoconducting sheet, or a permanent dielectric drum may be used.

Other components may also be included. For example, there may be an ink-removing component 732 with one or more of a roller 734, a scraping or brushing element 736, or other devices to remove any excess ink remaining on the photoconductor after transferring imaged ink to the transfer roller.

Figure 8:
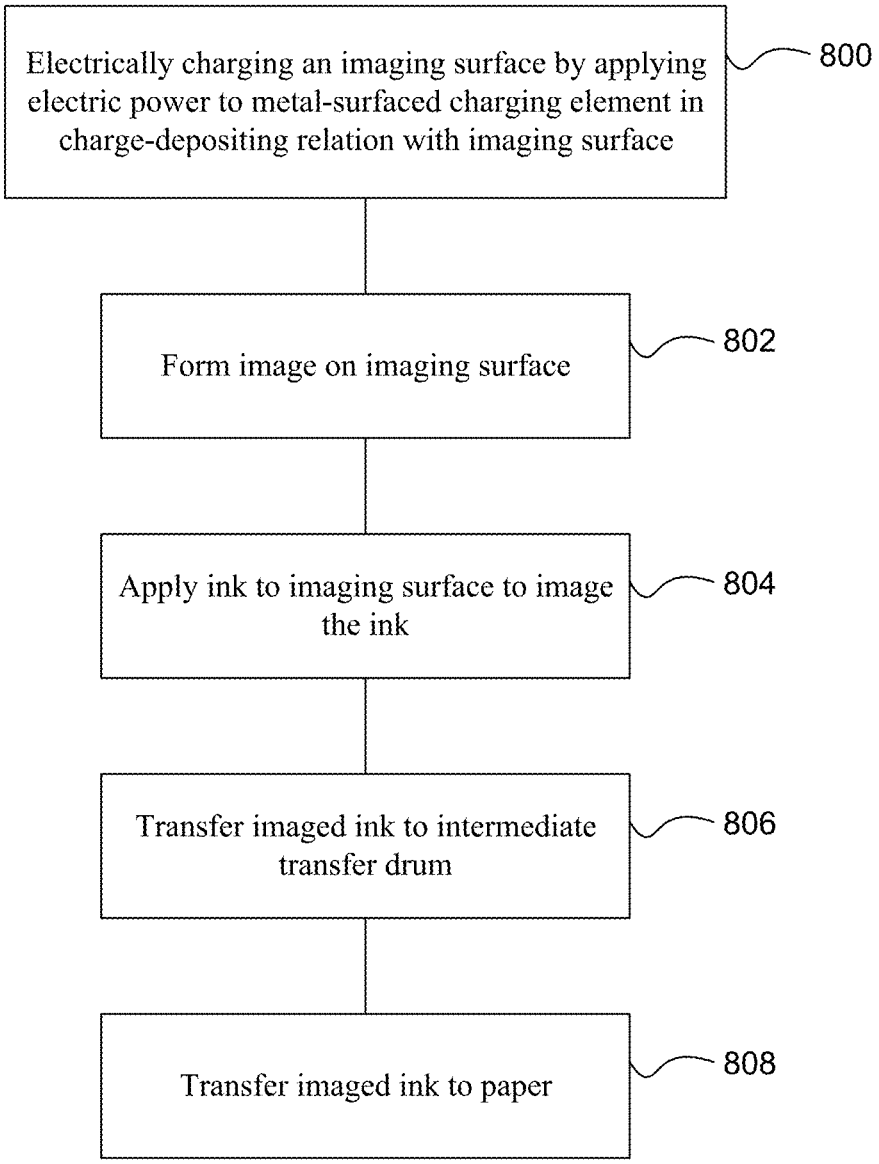
FIG. 8 is a flow chart of a method of printing with a metal-surface charging element according to an example.

FIG. 8 illustrates an example of a method of printing with a permanent charging element. An imaging surface is electrically charged by applying electric power to a metal-surface charging element in charge-depositing relation with the photoconductor, the electric power including an alternating-current (AC) component and a direct-current (DC) component (800). A charge image is formed on the electrically-charged imaging surface (802). Ink is applied to the imaging surface to image the ink according to the charge image (804). The imaged ink is transferred to an intermediate transfer drum (806) and from there to paper (808).

Figure 9:
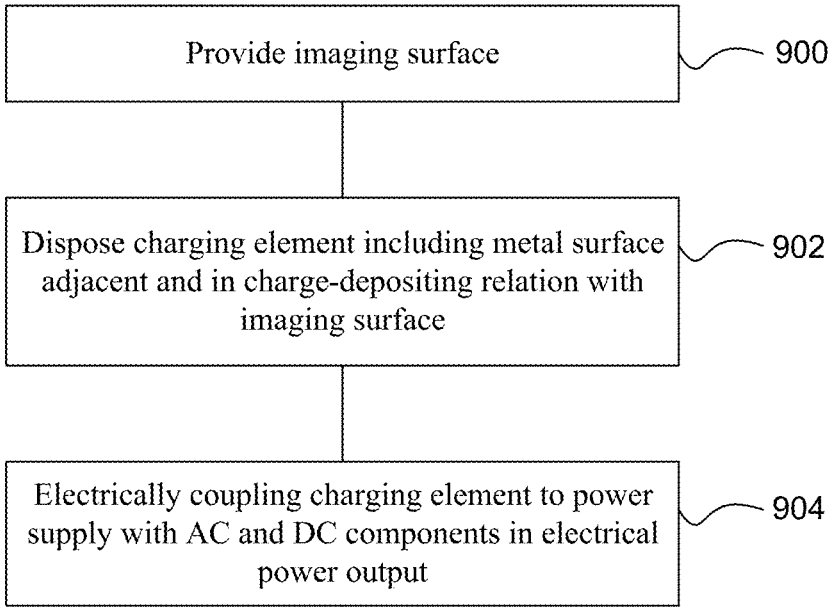
FIG. 9 is a flow chart of a method of manufacturing a printing system with a metal-surface charging element according to an example.

FIG. 9 gives an example of a method of manufacturing a printing system. The method includes providing an imaging surface (900) and disposing a charging element including a metal surface adjacent and in charge-depositing relation with the imaging surface (902). The method may further include electrically coupling the charging element to a power supply to provide electric power with an alternating current (AC) component and a direct current (DC) component (904). In some examples the imaging surface comprises a photoconducting cover on a drum, and in other examples it comprises a dielectric drum as discussed previously.

Charging elements with metal surfaces do not need to be replaced in normal use, thereby eliminating the time and expense of frequent charge-roller replacement and significantly reducing the cost-per-page of high-volume digital printing. Unlike composition-coated rollers, chemicals do not leach from metal charge rollers. Metal charge rollers are not adversely affected by environmental factors such as humidity or temperature. Metal rollers are simpler and less expensive to manufacture than composition-coated rollers. Eliminating the composition-coated roller can also eliminate any need for a balancing roller that is used to extend charge-roller lifespan in some kinds of printers.

We claim:

1. A printing system comprising:

a charging element comprising an electrically-conducting metal surface to deposit electric charge on an imaging surface during a printing operation of the printing system; and at least one of a spring and a weight coupled to the charging element to exert a biasing force on the charging element to reduce a gravitational force that the charging element applies towards the imaging surface.

2. The printing system of claim 1 wherein the charging element comprises one of a hollow metal cylinder and a solid metal roller.

3. The printing system of claim 1, further comprising a power supply to provide electric power with an alternating current (AC) component and a direct current (DC) component to the charging element.

4. The printing system of claim 3 wherein the AC component has amplitude between about 600 and 800 volts and a frequency between about 5 and 10 kHz.

5. The printing system of claim 3 wherein the DC component is between about −900 and −1,050 volts.

6. The printing system of claim 3 wherein the DC component has a magnitude between about 500 and 1,200 volts and the AC component has amplitude between about 500 and 1,000 volts and a frequency between about 2 kHz and 20 kHz.

7. The printing system of claim 1 and further comprising an imaging surface in physical contact with the charging element.

8. The printing system of claim 1, further comprising the imaging surface disposed in charge-receiving relation to the charging element, rotationally coupled to the charging element, and spaced apart from the charging element by a gap.

9. The printing system of claim 1, further comprising:

the imaging surface in charge-receiving relation to, and rotationally coupled to, the charging element;

a laser rotationally downstream from the charging element and aimed at the imaging surface;

a plurality of ink developer rollers rotationally downstream from the laser in ink-transfer relation to the imaging surface;

an intermediate transfer drum rotationally downstream from the charging element; and an impression drum rotationally coupled to the intermediate transfer drum and defining with the intermediate transfer drum a paper flow path.

10. The printing system of claim 1 wherein the printing system comprises a liquid electrophotographic printer.

11. A method of printing with a metal-surface charging element comprising:

electrically charging an imaging surface by applying electric power to a metal-surface charging element in rotational and charge-transferring relation with the imaging surface;

using at least one of a spring and a weight to exert a biasing force on the metal-surface charging element to reduce a gravitational force that the metal-surface charging element applies towards the imaging surface;

forming a charge image on the electrically-charged imaging surface;

applying ink to the imaging surface to image the ink according to the charge image;

transferring the imaged ink to a transfer roller; and transferring the imaged ink from the transfer roller to paper.

12. The method of claim 11 wherein the electric power includes an AC component with amplitude between about 500 and 1,000 volts and a frequency between about 2 and 20 kHz.

13. The method of claim 11 wherein the electric power includes a DC component with a potential between about 500 and 1,200 volts.

14. A method of manufacturing a printing system, the method comprising:

providing an imaging surface;

disposing a charging element including a metal surface adjacent and in charge-depositing relation with the imaging surface; and using at least one of a spring and a weight to exert a biasing force on the charging element to reduce a gravitational force that the charging element applies towards the imaging surface.

15. The method of claim 14, further comprising electrically coupling the charging element to a power supply to provide electric power with an alternating current (AC) component and a direct current (DC) component.

16. The method of claim 14 wherein the imaging surface is selected from the group comprising a drum carrying a photoconducting cover and a dielectric drum.

* * * * *